US007676970B2

(12) United States Patent
Charbonneau

(10) Patent No.: US 7,676,970 B2
(45) Date of Patent: Mar. 16, 2010

(54) APPARATUS FOR SEQUENTIALLY DISPLAYING A PLURALITY OF ADVERTISEMENT SHEETS

(75) Inventor: Yvon Charbonneau, Beaconsfield (CA)

(73) Assignee: Sirona Inc., London (GB)

( * ) Notice: Subject to any disclaimer, the term of this patent is extended or adjusted under 35 U.S.C. 154(b) by 628 days.

(21) Appl. No.: 10/563,300

(22) PCT Filed: Jun. 30, 2004

(86) PCT No.: PCT/CA2004/000970

§ 371 (c)(1),
(2), (4) Date: Jan. 4, 2006

(87) PCT Pub. No.: WO2005/004091

PCT Pub. Date: Jan. 13, 2005

(65) Prior Publication Data

US 2006/0156597 A1 Jul. 20, 2006

(30) Foreign Application Priority Data

Jul. 4, 2003 (CA) ..... 2434291

(51) Int. Cl.
*G09F 19/00* (2006.01)
*G09F 11/18* (2006.01)

(52) U.S. Cl. ..... 40/470; 40/518; 40/353

(58) Field of Classification Search ..... 40/470, 40/471, 518, 353
See application file for complete search history.

(56) References Cited

U.S. PATENT DOCUMENTS

| | | | | |
|---|---|---|---|---|
| 2,493,530 | A * | 1/1950 | De Saussure | 40/124.4 |
| 5,276,987 | A * | 1/1994 | Honse | 40/511 |
| 5,353,534 | A * | 10/1994 | Fassauer et al. | 40/524 |
| 5,678,333 | A * | 10/1997 | Aiken, Sr. | 40/518 |
| 5,953,540 | A | 9/1999 | Raymond et al. | |
| 5,983,546 | A * | 11/1999 | Aiken, Sr. | 40/618 |
| 6,505,427 | B1 * | 1/2003 | Sterling et al. | 40/508 |

FOREIGN PATENT DOCUMENTS

DE 44 34 310 A1 3/1996

* cited by examiner

*Primary Examiner*—Victor Batson
*Assistant Examiner*—David C Reese
(74) *Attorney, Agent, or Firm*—Ogilvy Renault LLP

(57) ABSTRACT

A display apparatus (10, 10') for sequentially displacing sheets (A) to a display position, comprising a drive (20) for displacing sheets (A) in a circuit to a display position. An actuator (30) actuates the drive (20). Connector devices (40, 50) connect opposed ends of sheets (A) along the drive (20). Each connector device (40, 50) has (i) a first connector (40) securing a first edge portion (A1) of a sheet (A) to the drive (20), and (ii) a second connector device (50) having a longitudinal member (41') secured to a second edge portion (A2) of the sheet (A) and connected to the drive (20) so as to be restrictively displaceable along the drive (20). An abutment portion (43') is securable against the longitudinal member (41') for retaining the edge portion (A2) of the sheet (A) therebetween. A tensioner (52) connects the longitudinal member (41') to the drive (20) to maintain the sheet in a taut condition with a predetermined tension.

8 Claims, 5 Drawing Sheets

APPARATUS FOR SEQUENTIALLY DISPLAYING A PLURALITY OF ADVERTISEMENT SHEETS

CROSS-REFERENCE TO RELATED APPLICATION

This application claims priority on Canadian Patent Application No. 2,434,291, filed on Jul. 4, 2003.

TECHNICAL FIELD

The present invention generally relates to scrolling display apparatuses for sequentially displaying advertisement sheets and, more particularly, to connector mechanisms for connecting advertisement sheets to a scrolling apparatus.

BACKGROUND ART

Display apparatuses with sequential scrolls of advertisement sheets are well known and broadly used. Such apparatuses allow advertisers to share display spaces and owners of the spaces to profit from the rental of these spaces.

A well-known type of these scrolling display apparatuses comprise a pair of parallel rollers spaced from one another. A film supporting a sequence of advertisement images is unwound from the first roller to be wound onto the second roller in a first displaying sequence. Once the film has been completely unwound from the first roller, the sequence is reversed to wind the film onto the first roller.

Although such display apparatuses are relatively simple, the nonuniform sequence of the image display is problematic. More specifically, the end images get about half as much exposure as the in-between images of the film. Also, when the film reaches an end of the sequence, the penultimate image is shown twice in a three-display sequence. Accordingly, the attention span of an observer may be shortened by the lack of novelty in the displays he observes. Also, it is known that the attention span is relatively short, and it is therefore preferable to squeeze as many different images as possible into this attention span, rather than showing a repeat of a same image.

Accordingly, other types of display apparatuses have been provided with continuous display sequences. For instances, U.S. Pat. No. 5,276,987, issued on Jan. 11, 1994, to Honse, discloses a display system for advertisement sheets having a storage rack with an entrance and an exit. A belt drive entrains a first display sheet from the exit in a circuitous pathway to a display area. Thereafter, the first display sheet is returned to the entrance of the storage rack, behind the other sheets. This display system operates in a "first-in, first-out" fashion, whereby all other display sheets will have to be displayed prior to the first display sheet being entrained by the belt drive.

In such display systems, the display sheets must be installed onto the existing belt drives. The display sheets are, for instance, glued to the drives, or have connectors (such as zipper, Zip-lock™ mechanisms) glued thereto for subsequent installation on the drive.

Unfortunately, the bonding of the connectors to the display sheets or of the display sheets to the drive is not very convenient, especially if the bonding takes place on site. For instance, the curing time of bonds or glues is typically 24 hours at room temperature before exposure to lower temperatures. Accordingly, the bonding of the advertisement sheet to the connectors cannot be performed on outdoor sites below certain temperatures. In cases where connectors are used, it is possible to supply additional sets of connectors to be bonded to the advertisement sheets prior to the on-site installation. However, this represents additional costs, and hence is not an optimal solution considering that the advertisement sheets are relatively cheaper in price than the connectors. It is possible to lessen the strength of the bond or shorten the curing time, but this may ultimately result in the advertisement sheets dislodging from the display system, and cause inoperability of the display system.

Accordingly, because of the inconvenience provided by the use of glue or bond fixing the connectors to the advertisement sheets, some advertisement sheets of display apparatuses go unchanged in some cooler countries during the cooler periods. Therefore, such display apparatuses are less appealing to some products having shorter lifespans, if advertisement contracts are struck with relatively long terms (e.g., six months) that are scheduled to avoid advertisement sheet changes in the cooler weather.

Another drawback of display apparatuses is the premature ripping of advertisement sheets. The advertisement sheets are typically of a nonextendible material, and the connectors attaching the advertisement sheets of the display apparatus keep the advertisement sheets taut. The advertisement sheets are displaced in a circuit in which they follow both straight and arcuate paths. In the arcuate paths of the circuit, the distance between the connectors at opposite ends of an advertisement sheet often varies slightly, thereby causing unwanted tension or ballooning in the advertisement sheet. This unwanted tension can cause the advertisement sheet to rip, thereby causing the inoperability of the display apparatus. This situation is likely to occur during cooler periods, in which the advertisement sheets contract due to exposure to cold temperatures. Considering the inefficient change of advertisement sheets: as set forth above, the ripping of an advertisement sheet in cold weather is likely to result in an extended downtime of the display apparatus.

SUMMARY OF INVENTION

Therefore, it is a feature of the present invention to provide a display apparatus that substantially overcomes the disadvantages of the prior art.

It is a further feature of the present invention to provide a display apparatus in which display sheets are changeable on site for immediate use notwithstanding the ambient temperature.

Therefore, in accordance with the present invention, there is provided a display apparatus for sequentially displacing sheets to a display position, comprising: a drive for displacing sheets to a display position; an actuator for actuating the drive; and at least one connector for connecting a sheet to the drive such that the sheet is displaceable to the display position, the connector having a longitudinal member connected to the drive for supporting an edge portion of the sheet, and an abutment portion securable against the longitudinal member for retaining the edge portion of the sheet therebetween.

Further in accordance with the present invention, there is provided a display apparatus for sequentially displacing sheets to a display position, comprising: a drive for displacing sheets in a circuit to a display position; an actuator for actuating the drive; and at least one connector device for connecting opposed ends of a sheet along the drive, the connector device having (i) a first connector securing a first edge portion of a sheet to the drive, and (ii) a second connector device having a longitudinal member secured to drive so as to be restrictively displaceable along the drive, an abutment portion securable against the longitudinal member for retaining the edge portion of the sheet therebetween, and a tensioner connecting the longitudinal member to the drive to maintain the sheet in a taut condition with a predetermined tension.

Still further in accordance with the present invention, there is provided a connector for connecting a sheet to a drive of a display apparatus for sequentially displacing sheets to a display position, comprising: a longitudinal member for supporting an edge portion of the sheet; connector ends for connecting the longitudinal member to the drive; and an abutment portion securable against the longitudinal member for retaining the edge portion of the sheet therebetween.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
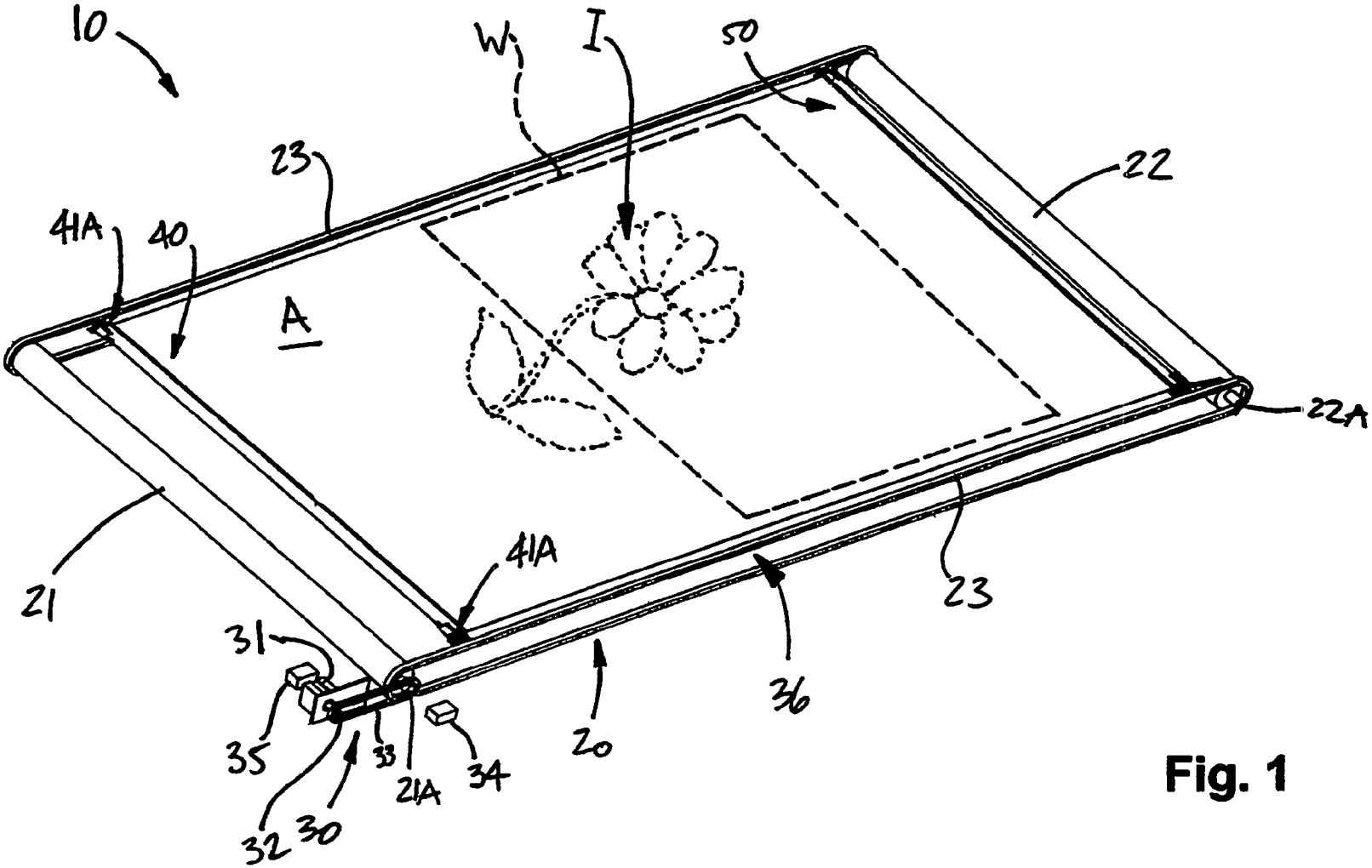
FIG. 1 is a perspective view of a display apparatus constructed in accordance with a first embodiment of the present invention.

Referring to the drawings, and more particularly to FIG. 1, a display apparatus constructed in accordance with the present invention is generally shown at 10. The display apparatus 10 generally comprises a drive 20, an actuator 30, a first connector 40 and a second connector 50 to displace sheets (i.e., advertisement sheets, support sheet for advertisement posters, etc.) such as that illustrated by A to a display position. As an example, a display window is schematically shown at W. Thus, in the display position, an image I on the sheet A (e.g., sheet A being an advertisement sheet in FIG. 1) is in register with the display window W so as to be seen by an observer through the display window W.

The drive 20 is provided to displace the advertisement sheet A to the display position. Components of the drive 20 will bear reference numerals from 20 to 29. The drive 20 has a drive roller 21 and an idler roller 22. The drive roller 21 and the idler roller 22 are parallel and spaced from one another. The drive roller 21 has an axle 21A about which it rotates. Similarly, the idler roller 22 has an axle 22A about which it rotates. The drive roller 21 and the idler roller 22 are operatively interconnected by a pair of drive belts 23 (or, alternatively, chains, moving carpet or the like), by which an actuation of the drive roller 21 will be transmitted to the idler roller 22.

Figure 2:
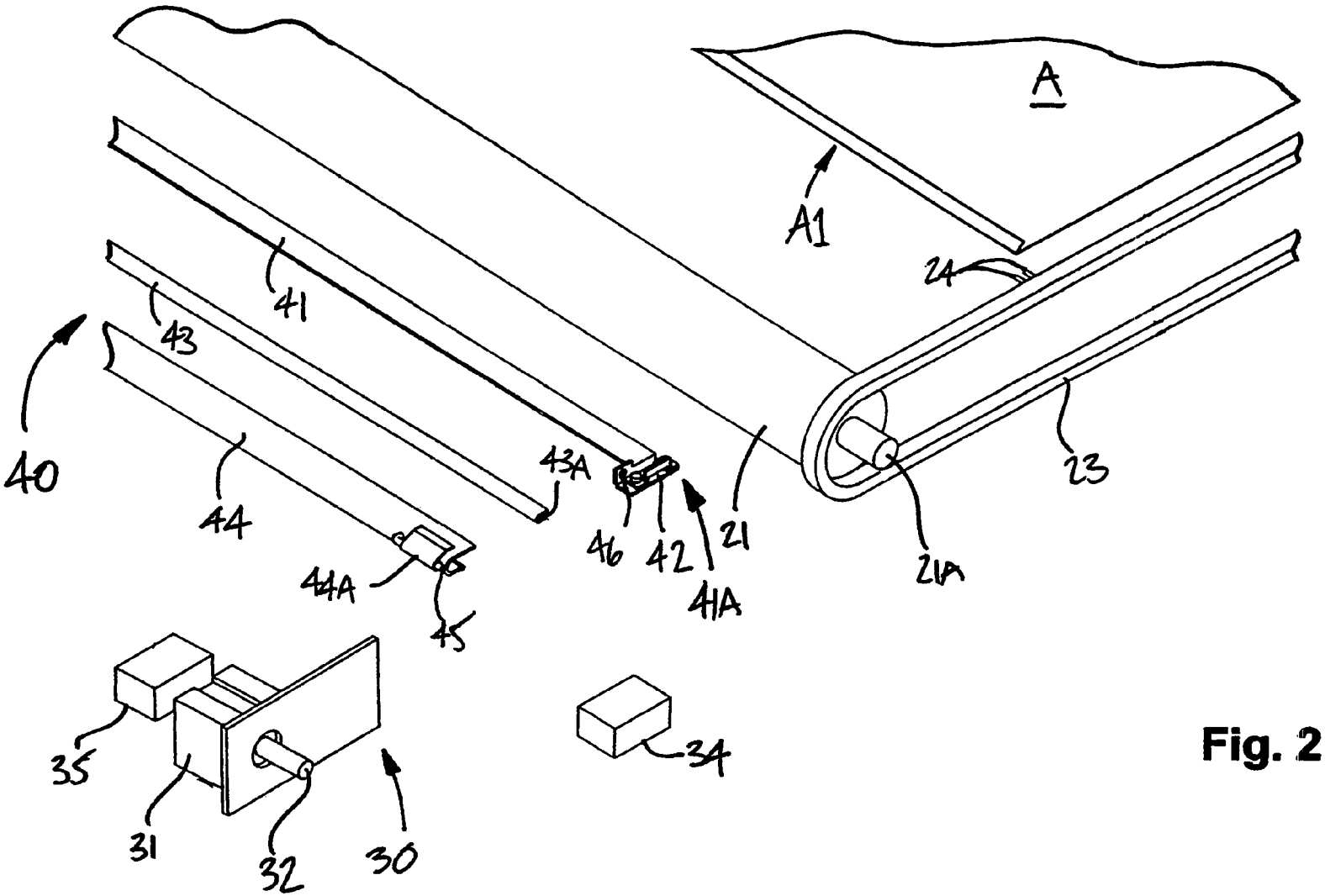
FIG. 2 is an enlarged, exploded view of a first connector end of the display apparatus.
Figure 3:
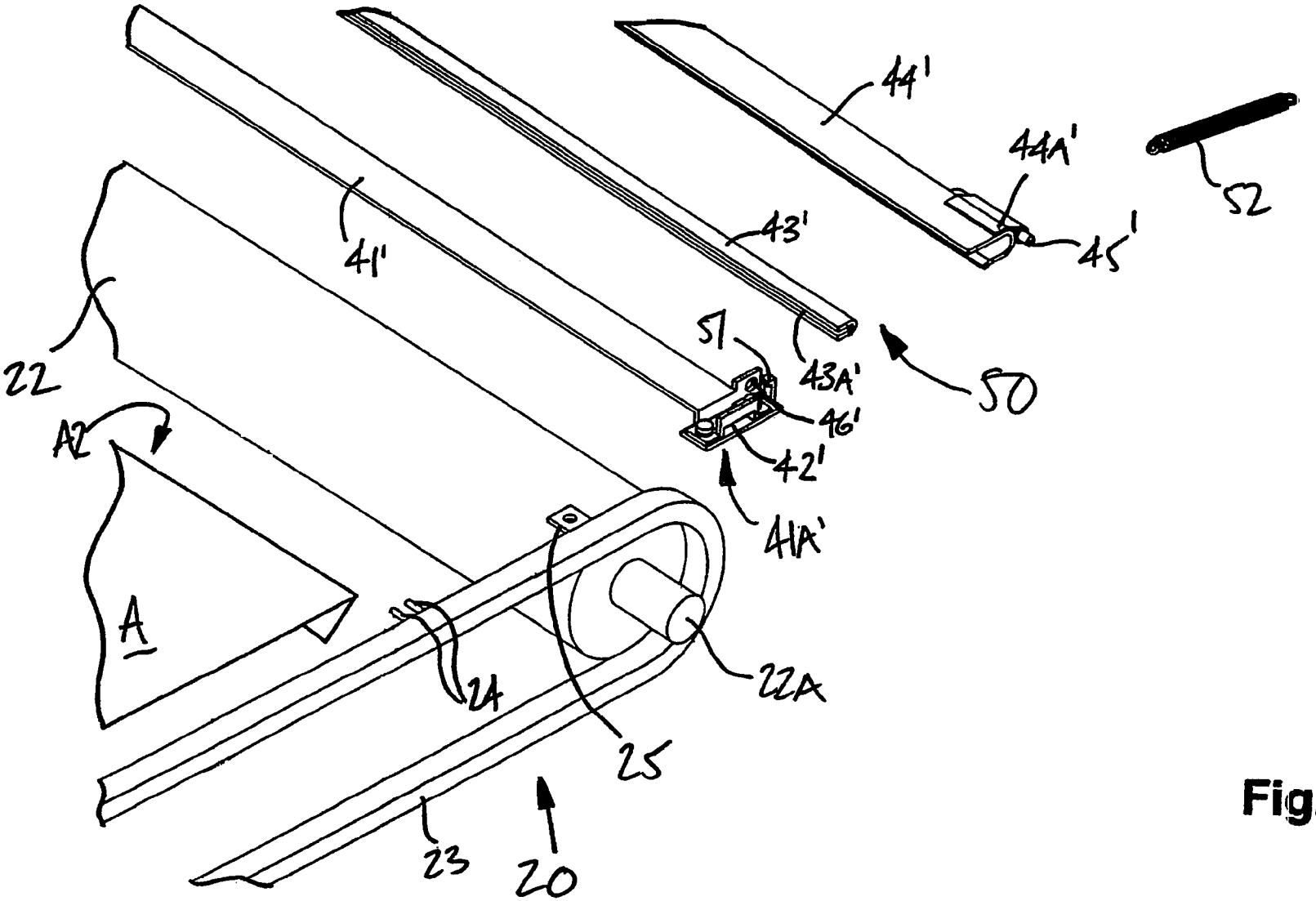
FIG. 3 is an exploded, enlarged perspective view of a second connector of the display apparatus.
Figure 4:
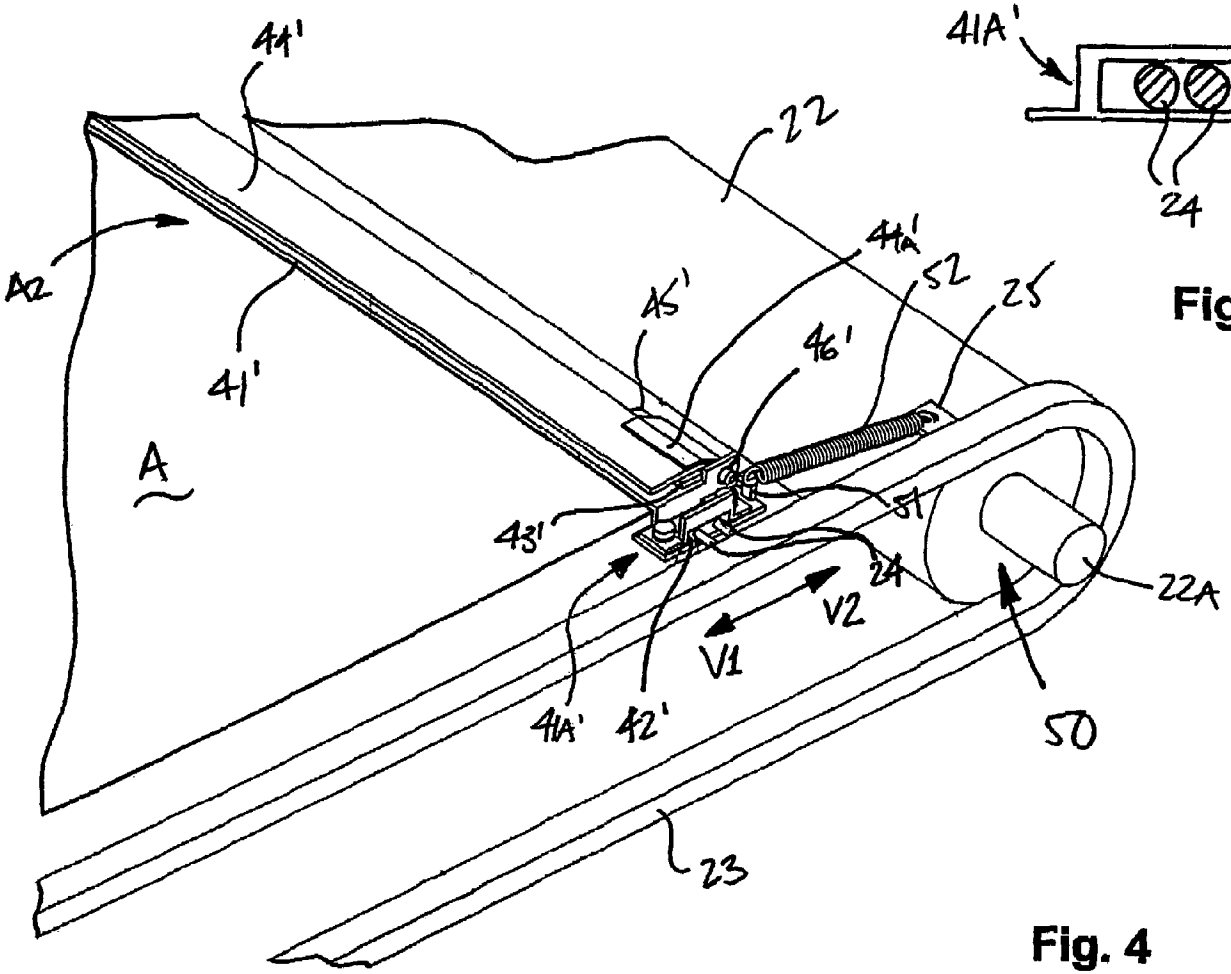
FIG. 4 is an enlarged perspective view of the second connector.

In the preferred embodiment, the drive belts 23 ensure that the drive roller 21 and the idler roller 22 have the same rotational speed. The outer surfaces of the drive roller 21 and the idler roller 22 may be the drive belts 23, or may be equipped with sprockets when the drive belt 23 is a chain. As seen in FIGS. 2 to 4, the drive belts 23 are provided with connection pins 24 and connection plates, one of which is shown at 25 in FIGS. 3 and 4.

Referring to FIGS. 1 and 2, the actuator 30 is provided for actuating the drive 20. Components associated with the actuator 30 will bear reference numerals from 30 to 39. The actuator 30 has a motor 31. The motor 31 has an output shaft 32, which is operatively connected to the axle 21A of the drive roller 21 by way of a drive belt or chain 33 or the like, and appropriately equipped for the drive transmission from the actuator 30 to the drive 20. Therefore, the drive roller 21 will be actuated by the motor 31.

The actuator 30 also has a sensor 34 and a controller 35. The controller 35 is wired to the motor 31 so as to control the actuation of the motor 31 as a function of signals from the sensor 34. Accordingly, once an advertisement sheet is in the appropriate display position, the sensor 34, having detected this position, will signal to the controller 35 to pause the actuation of the motor 31 to hold the advertisement sheet A in the appropriate display position for a predetermined amount of time. A light source may be provided in the gap 36 between opposed sides of the actuation circuit, to illuminate the advertisement sheet A in the display position (FIG. 1).

Referring to FIG. 2, the first connector 40 is provided to connect a first edge portion A1 of the advertisement sheet A to the drive 20. The components of the first connector 40 will bear reference numerals from 40 to 49. The first connector 40 has a longitudinal support member 41 having connector ends 41A at opposed ends thereof one of which is shown in FIG. 3), by which it is connected to the drive 20. More precisely, the connector ends 41A each define a slot 42 that will receive therein a pair of connection pins 24 of the drive 20. The connection pins 24 are fitted without play in the slots 42, such that the longitudinal support member 41 is fixed between drive belts 23, as shown in FIG. 1.

An elongated spacer 43 defining a longitudinal channel 43A, and a bracket 44 (i.e., a removable cover) having connector ends 44A (one of which is shown in FIG. 2), are provided to anchor the first edge portion A1 of the advertisement sheet A to the longitudinal support member 41. The first edge portion A1 of the advertisement sheet A is preferably provided with a pleat. The first edge portion A1 is positioned onto the longitudinal support member 41, the latter being connected to the drive 20. The elongated spacer 43 could optionally be positioned on the longitudinal support member 41 to act as a cushion for the first edge portion A1 and increase the adherence thereon. The bracket 44 is installed thereafter to squeeze the first edge portion A1 against the spacer 43 to fix the first edge portion A1 of the advertisement sheet thereto. The elongated spacer 43 would reduce the risk of tear of the advertisement sheet A, at the pleat, and increase the adherence between the advertisement sheet A and the bracket 44.

Referring to FIG. 2, the bracket 44 is provided with a spring pin 45 that is biased outwardly to engage a hole 46 in the connector end 41A of the first connector 40. The opposite end of the bracket 44 is similarly mated to the respective connector end 41 of the first connector 40, yet a biasing action is not required thereat. The locking of the bracket 44 onto the longitudinal support member 41 is thus readily performed by manual actuation of the spring pin 45.

It is preferred to have the pleat at the first edge portion A1, as it has the effect of a hook for the advertisement sheet A on the longitudinal support member 41. However, if suitable clamping is provided by the abutment portion (i.e., the bracket 44), the first edge portion A1 can simply be retained between the bracket 44 and one of the surfaces of the longitudinal support member 41.

Referring to FIGS. 3 and 4, the second connector 50 is provided to connect a second edge portion A2 of the advertisement sheet A to the drive 20. The second connector 50 is relatively similar to the first connector 40. Hence, components of the second connector 50 having an equivalent on the first connector 40 will bear the same reference numeral with a prime. The second connector 50 has a longitudinal support member 41', with connector ends 41A' each defining a slot 42' for being connected to the drive 20. The second connector 50 also has an elongated spacer 43' defining a longitudinal channel 43A', and a bracket 44' with connector ends 44A' (one of which is shown at FIGS. 3 and 4.

Referring to FIG. 3, the second edge portion A2 of the advertisement sheet A is initially provided with a pleat. In similar fashion to the steps described above for connecting the first edge portion A1 to the longitudinal member 41, the second edge portion A2 is positioned onto the longitudinal support member 41', the latter being connected to the pair of connection pins 24 of the drive 20. The elongated spacer 43' could optionally be positioned on the longitudinal support member 41' to act as a cushion for the second edge portion A2 and increase the adherence thereon. The bracket 44' is installed thereafter to squeeze the second edge portion A2 against the spacer 43' to fix the second edge portion A2 of the advertisement sheet thereto. The bracket 44' is provided with a pin 45' spring biased outwardly to engage a hole 46' in the connector end 41A' of the second connector 50.

The spacers 43 and 43' preferably consist of a resilient material, such as a rubber or a similar polymeric material, to provide suitable friction and to act as a cushion. As mentioned above, the second edge portion A2 is preferably initially provided with a pleat, knowing the distance between the longitudinal support members 41 and 41' of the display apparatus 10. However, it is also contemplated to provide advertisement sheets free of pleats at the second edge portion, with the second edge portion being folded to define the pleat on site.

Figure 5:
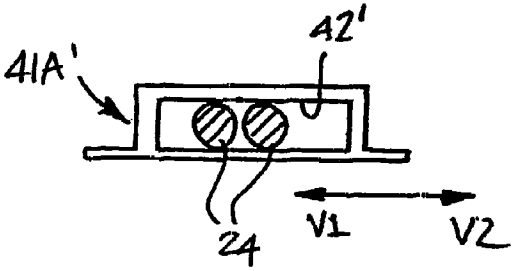
FIG. 5 is an enlarged side elevation view of a coupling between the a connector and of a drive of the display apparatus.

Referring to FIGS. 4 and 5, the slots 42' of the second connector 50, unlike the slots 42 of the first connector 40, are sized to allow a play of the second connector 50 in the directions illustrated by V1 and V2. The second connector 50 has fingers 51 on each of the connector ends 41A'. Each finger 51 is connected to a tensioner 52 having an end fixed to the connection plate 25 of the drive 20. In the preferred embodiment of the present invention, the tensioners 52 are tension springs, but may also be any type of elastic resilient member. The tensioners 52, in combination with the play of the second connector 50 with respect to the drive 20 (allowed by the size of the slot 42' versus the spacing between the connection pins 24) will keep the advertisement sheet A in a taut condition with a desired tension.

Preferably, the second connector 50 is the leading connector in the displacement of the advertisement sheet A in the display apparatus 10, whereas the first connector 40 is the following connector. It is also contemplated to have the second edge portion A2 secured to the display apparatus 10 first.

In an alternative embodiment of the present invention, a single connection pin 24 is provided for each slot 42 of the first connector 4Q and/or for each slot 42' of the second connector 50. In this alternative embodiment, the single connection pin 24 serves as pivot for the connectors 40 and 50. This alternative embodiment is advantageously used for rollers (e.g., such as the drive roller 21 and the idler roller 22) of relatively smaller radius, typically used in thinner assemblies, allowing for thinner sign constructions as opposed to bulkier constructions. On the other hand, the embodiment using pairs of connection pins 24 ensures an alignment between the connectors 40 and 50, and the plane of the sheet A, for straight portions of the pathway. The embodiment using pairs of connection pins 24 is advantageously used for rollers of relatively larger radius, typically used with thicker/larger assemblies.

The tensioners 52 enable a problem of typical display apparatuses 10 to be overcome. As is the case in the present display apparatus 10, the advertisement sheets follow arcuate paths at some point in their displacements in the display apparatus 10. When either one of the first connector 40 and the second connector 50 passes over either one of the rollers 21 and 22, the distance between the first connector 40 and the second connector 50 will decrease or increase slightly. The increase is due to the fact that the connectors 40 and 50 are flat and thus do not follow perfectly the arcuate path portions of the drive 20. The decrease is due to the fact that the advertisement sheets tend to follow a tighter arcuate path than the connectors 40 and 50, thereby causing some looseness in the advertisement sheets.

Therefore, in combination with the play between the slots 42' and the connection pins 24, the tensioners 52 will keep the advertisement sheets taut during the slight variations in the distance between the connectors 40 and 50, by contracting to absorb the looseness, or by extending to absorb the tensioning, that would otherwise be produced on the advertisement sheets (such as A in FIG. 1). This reduces the risk of possible damages to the advertisement sheets. The desired tension in the tensioner 52 is sufficient to maintain the advertisement sheets in a taut condition when absorbing the variation in distance between the connectors 40 and 50. It is pointed out that the interconnection between the drive 20 and the first connector 40 and the second connector 50 can have other suitable configurations as alternatives to the connections pins 24/slots 42 and 42' (e.g., flat plates, hooks, or the like).

In an alternative embodiment, in which the display apparatus 10 has the sheets A displaced in a vertical direction (i.e., with the rollers 21 and 22 parallel to the ground), the tensioners 52 could be removed, in which case the weight of the bottom connector (i.e., the first connector 40 in FIG. 1) keeps the sheet A in a taut condition. In such an embodiment, it is contemplated to provide some play between both connectors 40 and 50 and the pins 24, to enable a simultaneous back-and-forth motion between both connectors 40 and 50 and their respective connection pins 24. This play is provided by the length of the slots 42 and 42', which is determined as a function of the pathway (e.g., arcuate portions). In this embodiment, it is contemplated to use either single connection pins 24 or pairs of connection pins 24.

It is contemplated to use a semi-rigid self-standing panel for the advertisement sheets (e.g. A in FIG. 1), in which case only the second connector 50 (i.e., the leading connector) would be required. In such a case the panel should be flexible enough to curve in the arcuate path portions of the display apparatus 10, while regaining its planar shape for the display position.

Figure 6:
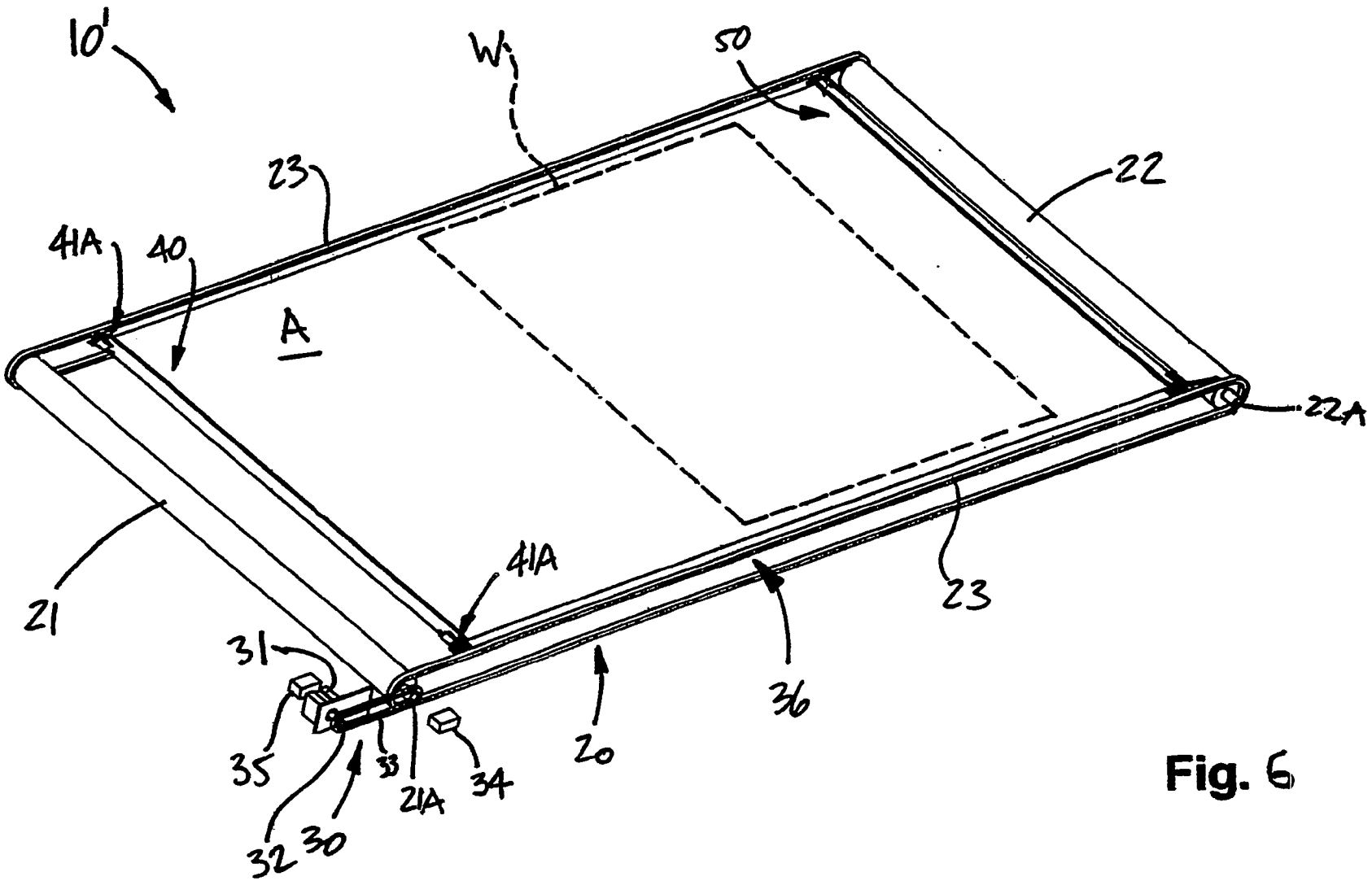
FIG. 6 is a perspective view of a display apparatus in accordance with a second embodiment of the present invention.

Referring to FIG. 6, an alternative embodiment is shown, in which the sheet A is a support sheet upon which an advertisement sheet (not shown) will be supported. The support sheet A is selected to as to be able to sustain the tension caused by the tensioners 52, and may be permanently secured to the longitudinal support members 41 and 41'.

The support sheet A is, for instance, a clear polycarbonate sheet, or of a similar material. The polycarbonate sheet A (e.g., thickness of 0.007") is capable of withstanding the tension caused by the tensioners 52, and is relatively stable in thermal expansion/contraction for the temperatures to which the display apparatus 10 or 10' will be exposed. The support sheet A is of a smaller length than the advertisement sheet it will support, if the advertisement sheet is also retained by the connectors 40 and 50, such that the support sheet A will absorb the tension caused by the tensioners 52, thereby lessening the risk of tearing of the advertisement sheet. It is also contemplated to provide the support sheet A in the form of a pocket (e.g., a pair of polycarbonate sheets superposed with an opening) for accommodating an advertisement sheet A.

Other means may be used to lessen the tension to which the advertisement sheet A of FIG. 1 is exposed. For instance, strips (e.g., of polycarbonate), wire braiding (e.g., of nylon) or thin metal wiring (e.g., of steel) could be used to interconnect the connectors 40 and, 50 so as to reduce the exposure of the advertisement sheet A to the tension.

As shown in FIG. 6, the idler roller 22 is held in position by a pair of biasing members 60. Although illustrated as being connected to the idler roller 22, these biasing members 60 could be connected to the drive roller 21. The biasing members 60 will help to keep the drive belt 23 in a taut condition.

It is within the ambit of the present invention to cover any obvious modifications of the embodiments described herein, provided such modifications fall within the scope of the appended claims.

The invention claimed is:

1. A display apparatus for sequentially displacing sheets to a display position, comprising:

at least one sheet folded over at an edge portion thereof to form a pleat, a free longitudinal edge of the pleat being unconnected to the at least one sheet to define an open pleat;

a drive for displacing sheets to a display position;

an actuator for actuating the drive; and at least one connector for connecting one of the at least one sheets to the drive such that the at least one sheet is displaceable to the display position, the connector having a longitudinal member connected to the drive such that the pleat is received against an edge of the longitudinal member with the at least one sheet lying on opposed surfaces of the longitudinal member, and an abutment portion securable against the longitudinal member on the at least one sheet for pressing the at least one sheet and the pleat against both the opposed surfaces of the longitudinal member.

2. The display apparatus according to claim 1, further comprising one other connector at an opposite edge portion of the at least one sheet for connecting the opposite edge portion of the at least one sheet to the drive.

3. The display apparatus according to claim 1, further comprising a resilient spacer between the abutment portion and the longitudinal member for retaining the edge portion of the at least one sheet between the abutment portion and the resilient spacer.

4. The display apparatus according to claim 1, wherein the drives displaces one of the at least one sheets in a continuous sequence.

5. The display apparatus according to claim 1, wherein the actuator has a sensor/controller for detecting one of the at least one sheets reaching the display position and for maintaining one of the at least one sheets in the display position for predetermined amounts of time.

6. The display apparatus according to claim 1, wherein the at least one sheet is a support sheet adapted to support an advertisement sheet.

7. A connector for connecting a sheet to a drive of a display apparatus for sequentially displacing sheets to a display position, comprising:

a longitudinal member for supporting an edge portion of the sheet;

connector ends at opposed longitudinal ends of the longitudinal member for connecting the longitudinal member to the drive;

an abutment portion securable against the longitudinal member for retaining the edge portion of the sheet therebetween; and a resilient spacer between the abutment portion and the longitudinal member for retaining the edge portion of the sheet between the abutment portion and the resilient spacer.

8. The connector according to claim 7, wherein the edge portion of the sheet has a pleat received against an edge of the longitudinal member such that the sheet lie on opposed surfaces of the longitudinal member, with the abutment portion abutting both the opposed surfaces.

* * * * *